US005606871A

United States Patent [19]

Hansen et al.

[11] Patent Number: 5,606,871

[45] Date of Patent: Mar. 4, 1997

[54] PACIFIER SHAPED TEETHER WITH COLD STORAGE CONTAINER

[75] Inventors: Robin Hansen, 7 Brussels St., San Francisco, Calif. 94134; Kenneth A. Tablow, Corte Madiera, Calif.

[73] Assignees: Robin Hansen; John Leon, both of San Francisco, Calif.

[21] Appl. No.: 306,384

[22] Filed: Sep. 13, 1994

[51] Int. Cl.[6] ..... F25D 3/08; A61J 17/00

[52] U.S. Cl. ..... 62/457.5; 62/441; 606/235

[58] Field of Search ..... 606/234–236; D24/194–199; 62/371, 457.5, 440, 441

[56] References Cited

U.S. PATENT DOCUMENTS

| | | | |
|---|---|---|---|
| 1,122,306 | 12/1914 | Reschke | 606/236 |
| 2,889,829 | 6/1959 | Tannenbaum et al. | 606/236 |
| 3,669,117 | 6/1972 | Merbst | 606/234 |
| 3,875,940 | 4/1975 | Beuther | 606/234 |
| 5,216,900 | 6/1993 | Jones | 62/371 |
| 5,300,089 | 4/1994 | Sassin | 606/236 |
| 5,421,172 | 6/1995 | Jones | 62/457.5 |

FOREIGN PATENT DOCUMENTS

| | | | |
|---|---|---|---|
| 9423686 | 10/1994 | WIPO | 606/234 |

*Primary Examiner*—Michael H. Thaler
*Assistant Examiner*—Glenn Dawson

[57] ABSTRACT

The present invention pertains to a pacifier shaped teether with an internal bladder filled with food grade propalyne glycol which can be brought to freezing temperatures while maintaining it's liquid nature. There is a hollow portion in the mouth guard of the pacifier which is connected to a hemispherical chamber allowing room for expansion of the bladder into the chamber as the nipple is being sucked. One or more pacifier shaped teether(s) may be stored in a portable, insulated, gel ice filled storage container thereby keeping the pacifiers cold for several hours.

5 Claims, 3 Drawing Sheets

PACIFIER SHAPED TEETHER WITH COLD STORAGE CONTAINER

FIELD OF THE INVENTION

This invention relates to devices for soothing discomfort which is experienced by babies during teething and to satisfy the sucking urge which occurs in babies. The invention relates specifically to the pacifier type device and cold storage container for said device. More particularly, the pacifier of this invention relates to the pacifier which provides a cool, resilient teething surface and is stored in an insulated cold storage container.

BACKGROUND OF INVENTION

Baby soothers in general and pacifiers in particular have been in common use for many years. It is well known that pacifiers ideally provide the most comfortable surface possible against which a baby can chew to relieve the discomfort which attends teething and to accommodate the sucking desire of children.

As a result, pacifiers are typically made of both soft and hard rubber and any other material which combines resistivity and resiliancy to provide a surface best suited to relieve the discomfort of teething and to satisfy the sucking urge of children.

It has also been recognized that coolness (30 degrees to 65 degrees Fahrenheit) is soothing to babies who are teething. Fluid filled teething rings and other shapes which are refrigerated before use have been manufactured and used for years to satisfy the desire for having something cool and soothing for babies to chew on while teething.

Current pacifier designs do not incorporate built-in cooling liquid.

Current teething ring designs do not have the classic pacifier shape which babies enjoy. In addition, current teething ring designs are uncomfortable for the baby to hold because they are cold from refrigeration. In addition, manufacturers of current teething rings recommend that you do not put the teething ring in the freezer portion of the refrigerator because the liquid inside the teething ring is water and will freeze, causing the teething ring to be hard and uncomfortable for the baby. Furthermore, teething ring manufacturers have made no provision for keeping the teething ring cold while away from the home. Thus, the design of current pacifiers precludes their use as an effective cooling device because they don't have cooling liquid inside and the design of current teething rings are uncomfortable for children because they don't have the traditional pacifier shape and they are difficult to hold because they are cold. Furthermore, teething rings are less effective while travelling away from home because there is no specific means to keep them cool thus reducing their effectivness.

SUMMARY OF THE INVENTION

It is an objective of this invention to provide a pacifier which provides an internal cooling liquid to ease the discomfort of teething babies.

It is a further objective of this invention to incorporate a cooling liquid of food grade propalyne glycol which will not freeze when put in the freezer section of the refrigerator. It is a further objective of this invention to provide a storage container for one or more pacifiers which contains foam insulation and freezable gel within the inner and outer walls so that the enclosed pacifiers will remain cold even when away from the home. Therefore, the combination of one or more propalyne glycol filled pacifiers encased in an insulated, freezable gel walled storage container creates a system for providing cold, pacifier shaped teething devices even when away from home. Providing one or more cooling pacifiers in the insulated cold storage container insures that the baby will have a continual supply of cool teething relief. In addition, the holding ring of the pacifier rapidly warms to room temperature and therefore is comfortable to hold. In addition, a soft rubber or soft plastic material is installed on the outer perimeter of the hard plastic mouth guard so that the outer perimeter of the mouth guard may flex while the baby is lying on it's side in a horizontal position.

A BRIEF DESCRIPTION OF DRAWINGS

DESCRIPTION OF THE PREFERRED EMBODIMENT

Figure 1:
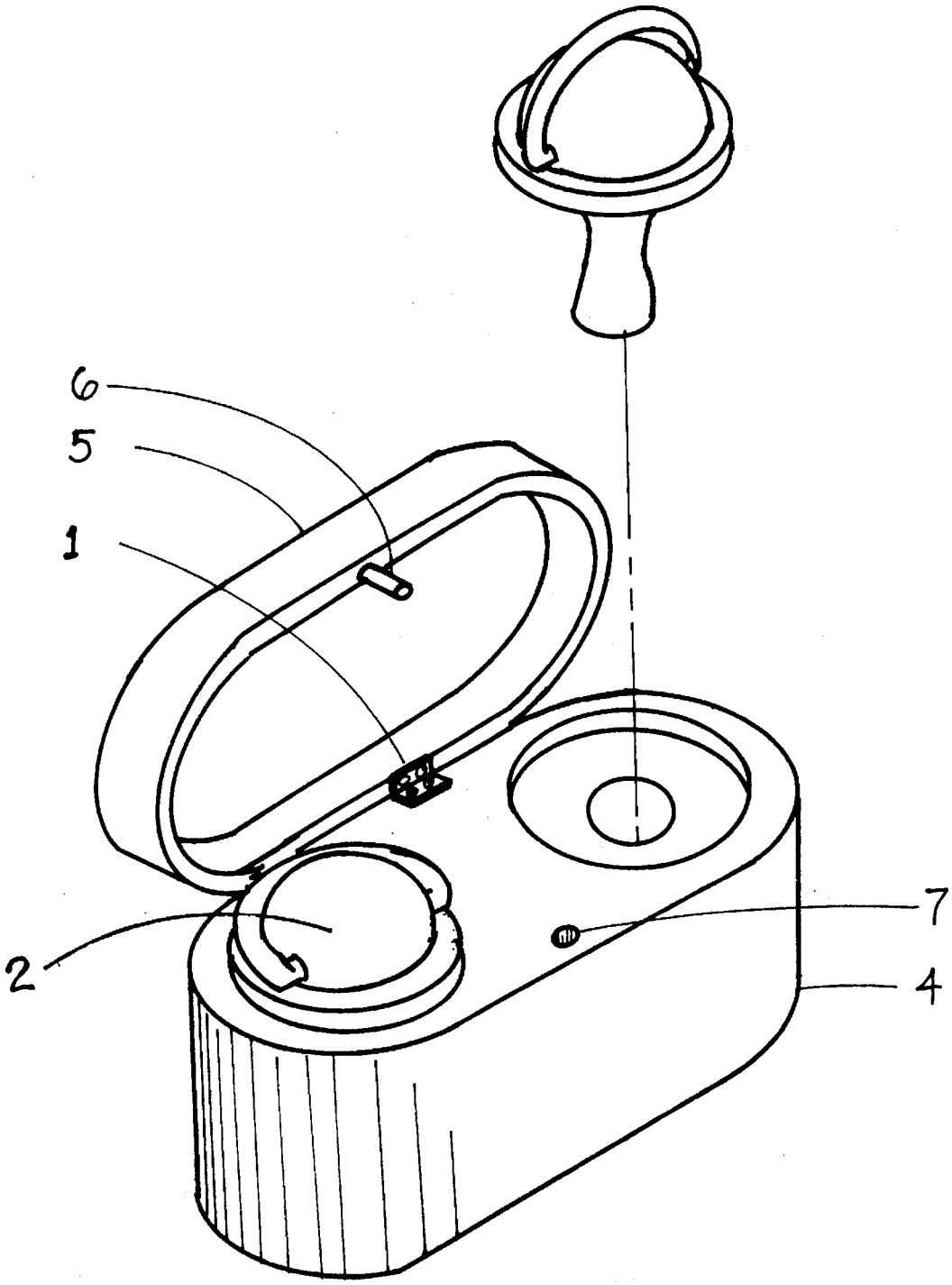
FIG. 1 is a perspective view of two pacifiers encased in their freezable storage container.
Figure 2:
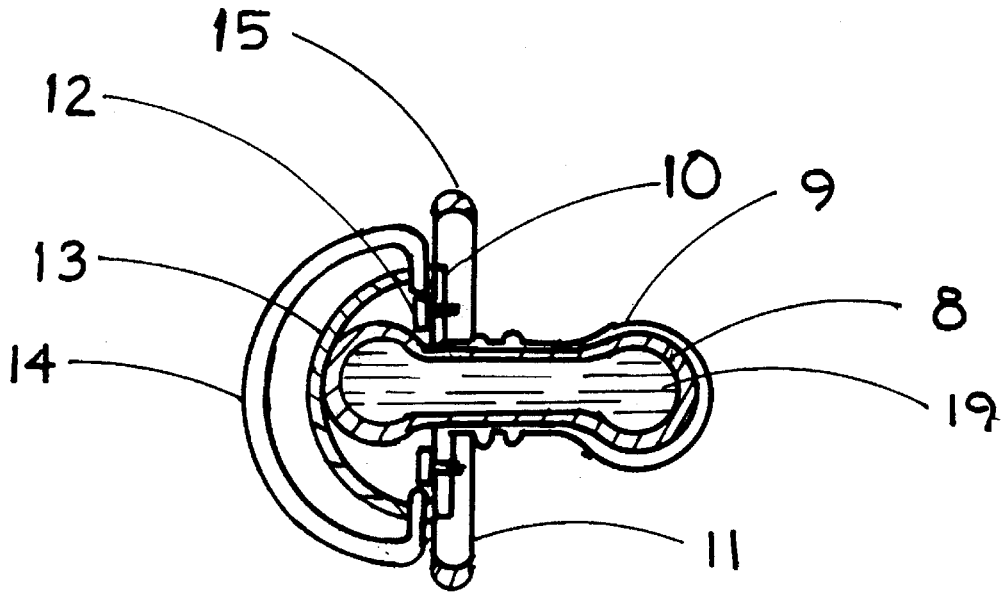
FIG. 2 is a cross section view of a single pacifier showing internal propalyne glycol filled bladder.
Figure 3:
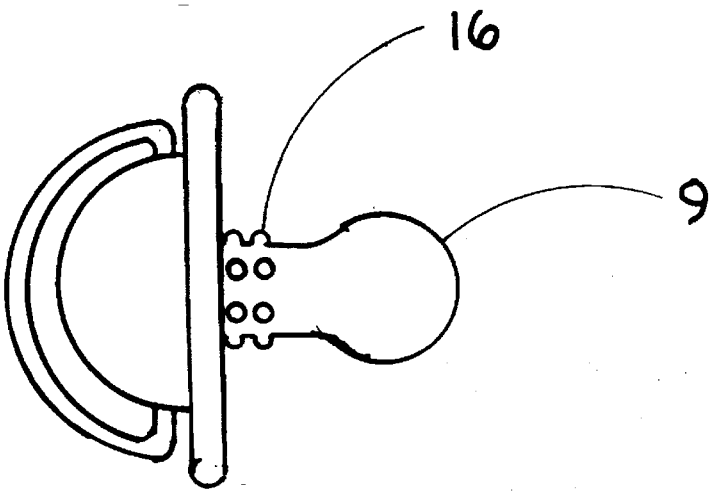
FIG. 3 is an external side view of pacifier showing nipple shape and teething bumps, mouth guard and handle.
Figure 4:
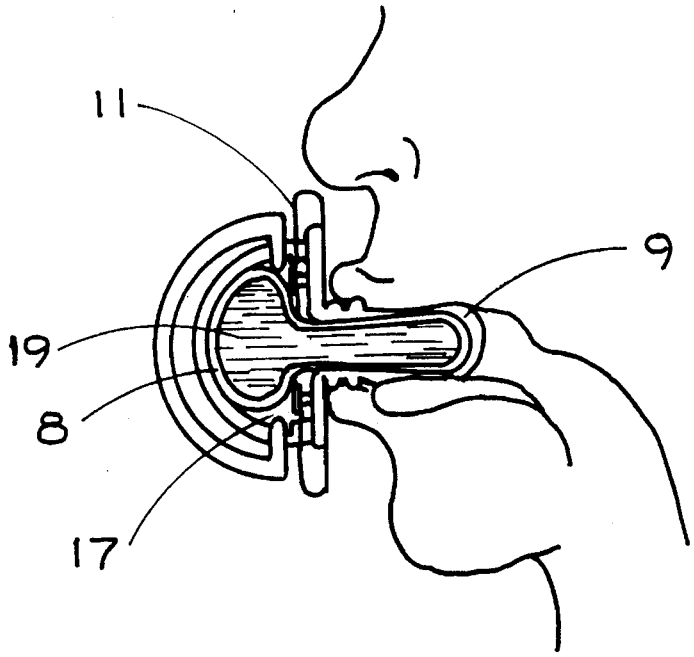
FIG. 4 is a section view of the pacifier showing the nipple portion compressed and the resulting compression of the internal liquid filled bladder in the nipple portion and expansion of the same bladder in the hemispherical portion located on the opposite side of the mouth guard.
Figure 5:
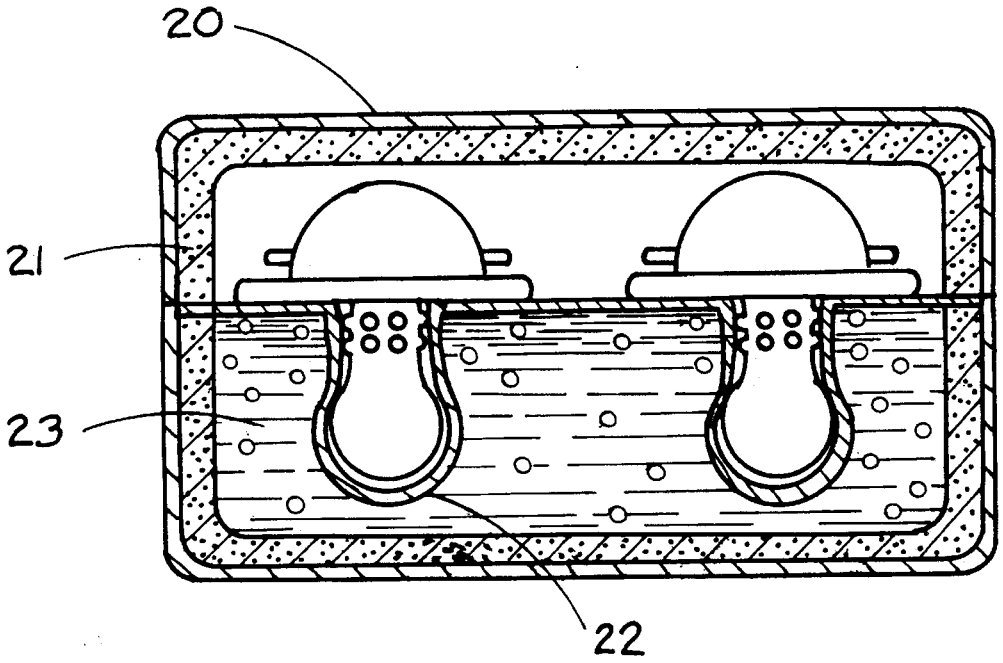
FIG. 5 shows a cross section view of the insulated freezable storage container with two cold teething pacifiers inside.

Two teething pacifiers (2 & 3) as well as the cold storage container (4) for holding said pacifiers is shown in FIG. 1. The lid of the cold storage container is hinged (1) in the rear. Snap (6) penetrates hole (7) to act as a closure. FIG. 2 shows a side section view of one pacifier with latex bladder (8) containing food grade propalyne glycol (19). Nipple (9) and integral shoulder (10) encase the latex bladder (8) and is made of silicone rubber or other resilient material. Mouth guard (11) is made of polypropalyne or other hard plastic. Nipple shoulder (10) is held to mouth guard (11) by means of heat stake rivet (12). Hemispherical cover (13) is glued or ultrasonically welded to mouth guard (11). Foldable handle (14) is retained by hemispherical cover (13). Soft mouth guard trim (15) goes around the perimeter of mouth guard (11) and is held in place by hemispherical cover (13) and is made out of soft rubber or other similar material. FIG. 3 shows exterior side view of teething pacifier. Small bumps (16) at base of nipple (9) help facilitate teething action. FIG. 4 shows nipple (9) in compressed position causing latex bladder (8) to compress in the nipple area (17) on the other side of the mouth guard (11). The baby's sucking action (18) causes nipple (9) to compress and then expand resulting in the cold propalyne glycol (19) to cycle between the nipple portion (9) and the hemispherical cover area (13). The sealed latex bladder (8) provides a satisfying resisitance as the baby sucks on nipple (9). Nipple (9) stays resilient even at sub-freezing temperatures because propalyne glycol (19) does not freeze solid. One or more teething pacifiers are stored in storage case as shown in FIG. 5. Storage case is comprised of outer shell (20), Inner foam insulation liner (21) gel material (23) such as blue ice or other similar freezing gel and inner wall (22). The entire unit as shown in FIG. 5 is placed in the freezer compartment of a home refrigerator for 1 hour or more causing gel material (23) to freeze. Tests have shown that teething pacifiers stay cold for at least 3 hours when stored in storage container (4). A parent may carry the storage container (4) containing the teething pacifiers (2 & 3) in a purse or baby bag so that the teething pacifiers (2 & 3) are available at any time. The baby sucks On pacifier (2) and when pacifier (2) is no longer cold, the parent replaces pacifier (2) into storage container (4) and pulls out cold pacifier (3) for use which allows time for pacifier (2) to become cold again. This pacifier rotation can be repeated as long as the insulated storage container remains cold.

I claim:

1. A cold storage case for storing a plurality of teethers, each teether having a nipple with a predetermined exterior contour, comprising:

an outer shell;

an inner shell positioned within said outer shell, said inner shell having a plurality of cooling cavities, each cavity having an interior contour configured to substantially complement said exterior contour of said teether for snugly receiving one of said nipple, and being sized and configured; and a cooling fluid disposed in a space between said outer shell and said inner shell, so that when said teethers are positioned in said cavity, and said cold storage case is cooled, said teethers are kept cold by said cooling fluid.

2. The cold storage case of claim 1, further including a lid for covering said cavities.

3. The cold storage case of claim 1, further including an inner insulation liner attached to an interior surface of said outer shell and coextensive therewith.

4. The cold storage case of claim 1, in combination with a plurality of teethers for being positioned in said cavities, each teether having a nipple with an exterior contour substantially complementing said interior contour of a corresponding cavity.

5. The cold storage case of claim 4, wherein said teethers are nipple-shaped, each teether having a hollow interior with a cooling fluid disposed therein.

* * * * *